United States Patent [19]

Rivas et al.

[11] Patent Number: 4,976,591

[45] Date of Patent: Dec. 11, 1990

[54] SELF LUBRICATING, TWO STAGE VARIABLE COMPRESSOR

[75] Inventors: Olegario Rivas, Caracas; Alejandro Newski, San Antonio de los Altos; Simon Antunez, Caracas-Miranda, all of Venezuela

[73] Assignee: Intevep, S.A., Caracas, Venezuela

[21] Appl. No.: 487,308

[22] Filed: Mar. 2, 1990

[51] Int. Cl.[5] ..... F04B 39/02

[52] U.S. Cl. ..... 417/254; 417/228

[58] Field of Search ..... 417/228, 254, 534, 538, 417/415

[56] References Cited

U.S. PATENT DOCUMENTS 3,036,529 5/1962 Archer ..... 417/254 X 4,750,870 6/1988 Curwey ..... 417/416

FOREIGN PATENT DOCUMENTS 2146530 3/1973 Fed. Rep. of Germany ..... 417/254

*Primary Examiner*—John C. Fox

*Attorney, Agent, or Firm*—Bachman & LaPointe

[57] ABSTRACT

A multi-stage compressor having variable volume compression ratios and automatic lubricating features. The multi-stage compressor comprises first and second pistons which are mounted for reciprocal movement in first and second cylinders so as to define a plurality of compression chambers. The pistons are rigidly connected by a connecting rod so as to define between the lubricating pumping chamber for lubricating the piston seals of the multi-stage compressor.

6 Claims, 2 Drawing Sheets

SELF LUBRICATING, TWO STAGE VARIABLE COMPRESSOR

BACKGROUND OF THE INVENTION

The present invention is drawn to a multi-stage compressor and, more particularly, a multi-stage compressor comprising a plurality of series connected compression stages of variable volume wherein the compressor includes a mechanism for automatically lubricating same during the operation thereof. The multi-stage compressor of the present invention may be driven by any suitable drive mechanism such as an internal combustion engine, electric motor or any other device which produces reciprocal movement of a piston rod. The multi-stage compressor of the present invention is particularly useful in compressing fluids, particularly gases, including natural gas, air, nitrogen and the like. The multi-stage compressor of the present invention is particularly useful for compressing gases which are produced at well sites during the production of crude oil from deep wells.

SUMMARY OF THE INVENTION

The present invention is drawn to a multi-stage compressor having variable compression ratios and automatic lubricating features. In accordance with the present invention, the multi-stage compressor comprises first and second pistons which are mounted for reciprocal movement in first and second cylinders so as to define a plurality of compression chambers. In accordance with the present invention, the pistons are rigidly connected by a connecting rod so as to define therebetween a pumping chamber for pumping lubricating oil to seals on the peripheral surfaces of the aforesaid pistons. A further feature of the multi-stage compressor of the present invention is the provision of variable volume compression chambers which enable one to vary the compression ratios of the chambers. The compressor of the present invention can be used for compressing various compressible fluids. In accordance with a particular feature of the present invention, the first and second pistons are of different diameters so as to allow for different compressions in each of the compression chambers. In accordance with a further feature of the present invention, the compressor can be driven by any suitable device which provides for reciprocal movement of the first and second pistons within the cylinders. Such devices include but are not limited to internal combustion engines, electric motors and the like.

DETAILED DESCRIPTION

As noted above, the compressor 10 of the present invention may be used to compress any compressible fluid and, particularly gases, such as natural gas, air, nitrogen and the like.

Figure 1:
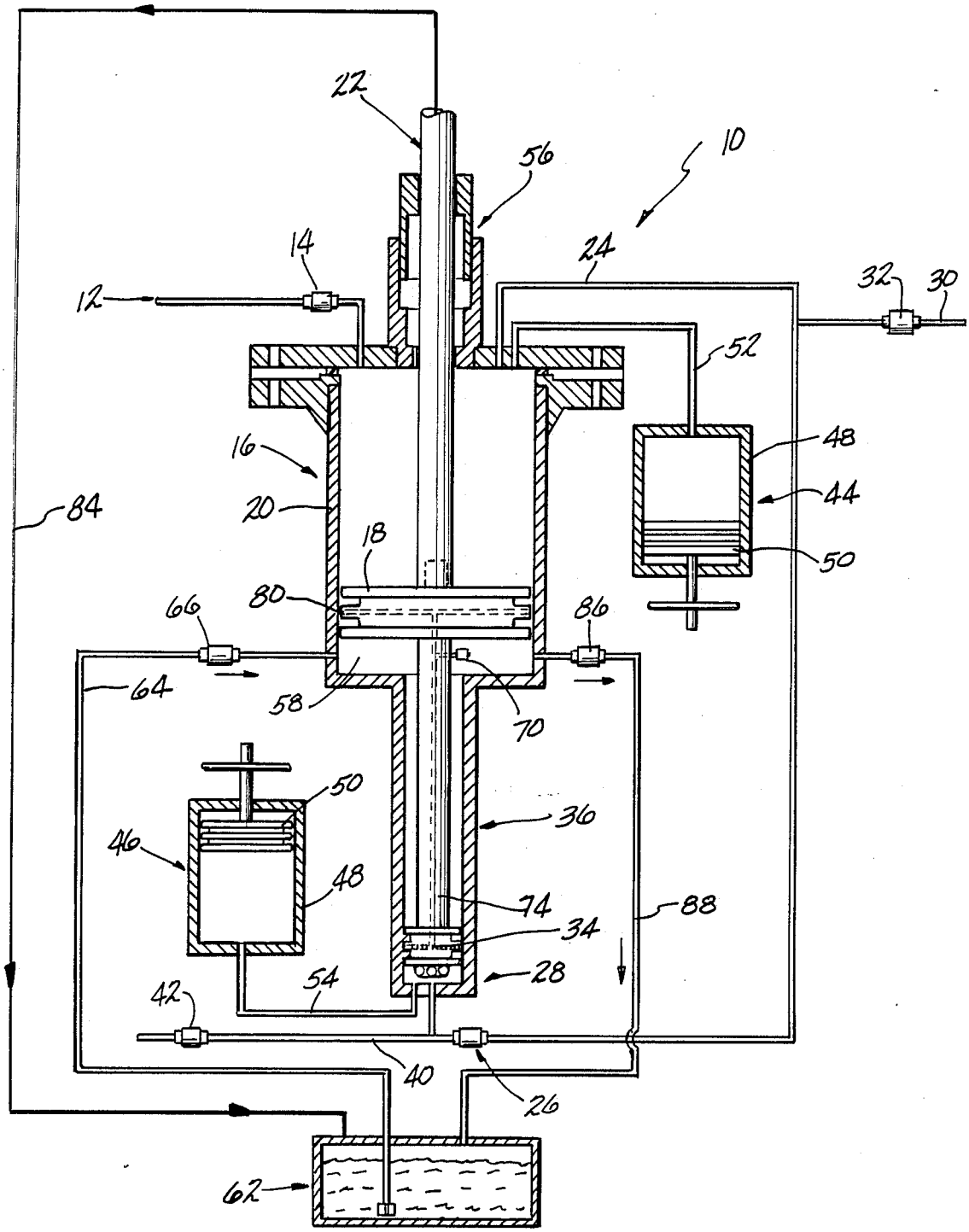
FIG. 1 is a schematic illustration showing the multi-stage compressor of the present invention.

With reference to the drawings and in particular FIG. 1 thereof, the compressor 10 is provided with an inlet pipe 12 provided with a one way check valve 14 for feeding a compressible fluid to a first low pressure stage 16 of the compressor 10. The first low pressure stage 16 comprises a piston 18 which is reciprocally movable within a cylinder 20. Reciprocal movement is transmitted to the piston 18 through a piston rod 22. A discharge pipe 24 provided with the one way check valve 26 connects the first low pressure stage 16 to a second high pressure stage 28 via one way check valve 26. In addition, discharge pipe 24 communicates compressed fluid from the first low pressure stage 16 to a pipe 30 via check valve 32.

The second high pressure stage 28 is similar to the first pressure stage 16 and comprises a piston 34 which is reciprocally movable in cylinder 36. The compressed fluid coming from the first low pressure stage 16 is subject to further pressure increase in the second high pressure stage 28. The compressed fluid from pressure stage 28 is discharged to a discharge pipe 40 and through check valve 42 for use and/or further compression. As illustrated in FIG. 1, piston 18 in first pressure stage 16 is larger than piston 34 in second pressure stage 28. Naturally, the size of the pistons 18 and 34 may be varied in any manner desired so as to obtain the desired compression of the fluid being compressed.

In addition to the size of the pistons employed in the multi-stage compressor of the present invention, control of the discharge pressure from both the low pressure stage 16 and the high pressure stage 28 of the compressor 10 may be obtained by employing variable volume chamber devices 44 and 46. The variable volume chamber devices 44 and 46 each comprise a cylinder 48 having an adjustable piston 50 mounted therein for varying the effective volume of the devices 44 and 46. The devices 44 and 46 are connected via lines 52 and 54, respectively, to the low pressure stage 16 and high pressure stage 28 of the multi-stage compressor. By varying the volume of the devices 44 and 46 by adjusting the position of piston 50 in the cylinders 48, the overall volume of the compression stages 16 and 28 can be controlled.

A stuffing box 56 is provided for sealing the piston rod 22 within the housing of the compressor 10. The piston rod 22 may be connected to any suitable drive means, as noted above, for effecting reciprocal movement of the pistons 18 and 34, respectively.

Figure 2:
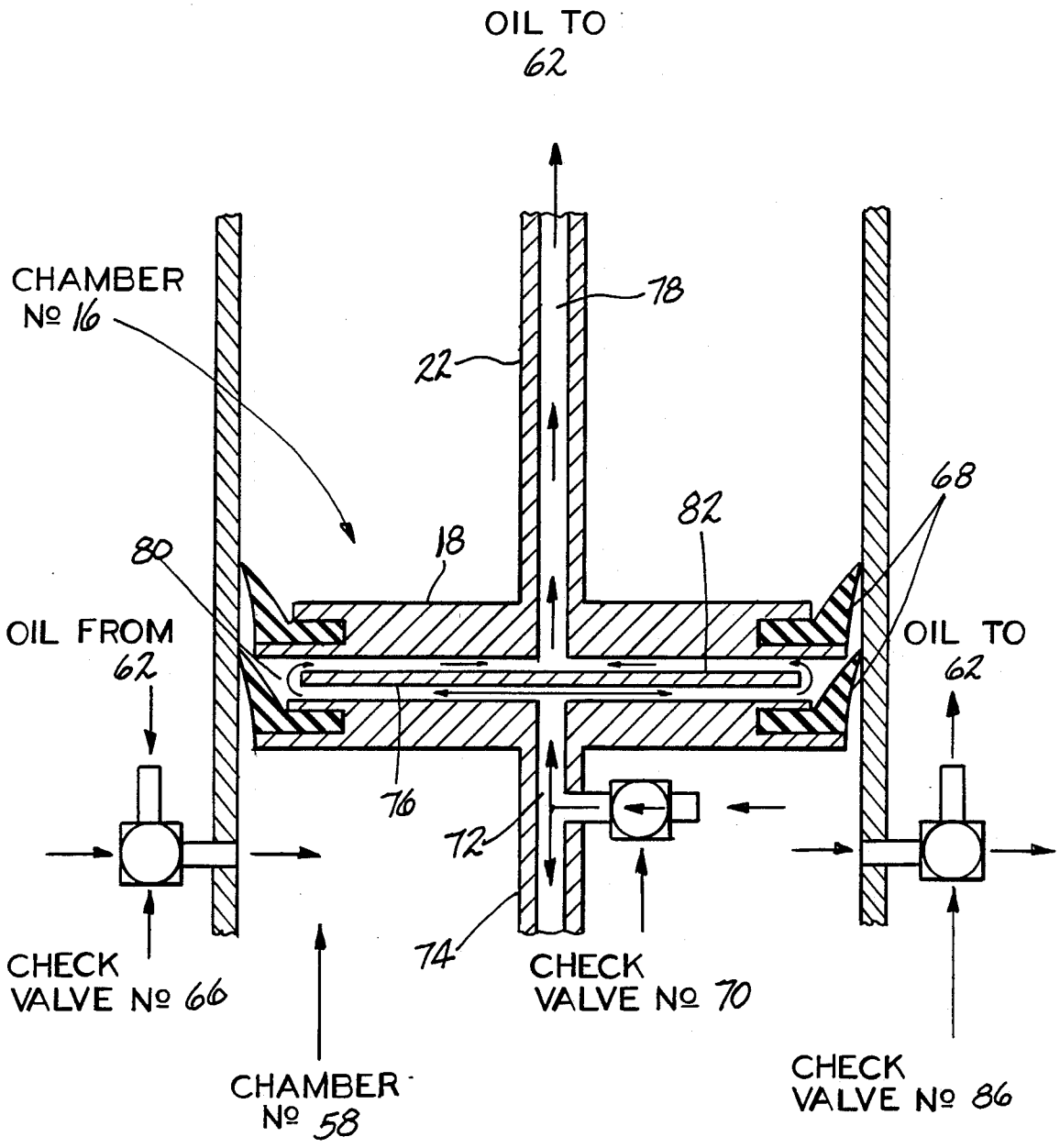
FIG. 2 is a schematic view of one of the pistons employed in the multi-stage compressor of the present invention showing the details of the lubricating paths.

In accordance with the particular feature of the present invention, the compressor 10 includes a lubricating pump chamber 58 which is formed between the pistons 18 and 34 of the low pressure stage 16 and high pressure stage 28, respectively. With particular reference to FIG. 2, a check valve 66 provides an oil inlet to lubricating pump chamber 54. As is clearly illustrated in FIG. 2, lubricating oil is fed from reservoir 62 via line 64 and check valve 66 into lubricating pump chamber 58 during the upward stroke of piston 22 and piston 18. On the downward stroke of the piston 18, oil is pumped from lubricating pump chamber 58 through check valve 70 into lubricating channel 72 provided in connecting rod 74 which connects pistons 18 and 34 rigidly together. The lubricating fluid in channel 72 is fed to the piston seals on the pistons 18 and 34, respectively, for lubrication thereof. While FIG. 2 illustrates only the lubrication of piston 18, it should be appreciated that lubrication of piston 34 occurs in the same manner. Again with reference to FIG. 2, oil is conducted through lubricating channel 72 in the connecting rod 74 to lubricating area 80 for lubricating the piston seals 68 of piston 18 via a channel 76 provided in piston 18. The lubricating fluid in lubricating area 80 is discharged to discharge channel 78 provided in piston rod 22 through channel 82 provided in piston 18. The discharged lubricating oil in discharge channel 18 is thereafter returned to oil reservoir 62 through pipe 84 as schematically illustrated in FIG. 1. As noted above, oil from the oil reservoir 62 is admitted into oil pump chamber 58 through pipe 64 and check valve 66. Oil pump chamber 58 is likewise connected to oil reservoir 62 via conduit 88 and variable pressure check valve 86. By varying the pressure required to open check valve 86, the pressure of the oil in the oil lubricating system is controlled. As noted above, discharge from the oil pump chamber 58 is connected to oil reservoir 62 via check valve 86 and conduit 88.

As can be seen from the foregoing Detailed Description, the multi-stage compressor of the present invention provides an automatically self lubricating function which is particularly advantageous. In addition, the compression chambers of the multi-stage compressor may be varied so as to control the compression of the fluid fed thereto.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A multi-stage compressor comprising a first piston mounted for reciprocal movement in a first cylinder and defining therewith a first compression chamber, a second piston mounted for reciprocal movement in a second cylinder and defining therewith a second compression chamber, connecting means for rigidly connecting said first piston and said second piston and defining therebetween a pumping chamber, first inlet means for delivering fluid to be compressed to said first compression chamber and first outlet means for removing compressed fluid from said first compression chamber, second inlet means in fluid communication with said first outlet means for delivering said compressed fluid to said second compression chamber for further compression and second outlet means for removing said compressed fluid from said second compression chamber, third inlet means for delivering lubricating oil from a reservoir to said pumping chamber and third outlet means for delivering lubricating fluid from said pumping chamber to said first and second pistons for lubricating between said pistons and cylinders.

2. A compressor according to claim 1 wherein said connecting means has a lubricating conduit in fluid communication with said third inlet means for receiving lubricating fluid therefrom.

3. A compressor according to claim 2 wherein said pistons are provided with sealing means for sealing said pistons in said cylinders and further include lubricating passage means for communicating lubricating oil from said lubricating conduit to said seal means.

4. A compressor according to claim 3 wherein said piston rod has a conduit for communicating oil from said sealing means to said reservoir.

5. A compressor according to claim 1 including fourth outlet means for by-passing fluid from said pumping chamber to said reservoir.

6. A compressor according to claim 1 wherein said first and second compression chambers are in fluid communication with first and second variable volume chambers respectively.

* * * * *